US007225731B2

(12) United States Patent
Bayer et al.

(10) Patent No.: US 7,225,731 B2
(45) Date of Patent: Jun. 5, 2007

(54) SHEET PUNCHING AND EMBOSSING MACHINE

(75) Inventors: Günther Bayer, Nettetal (DE); Gerhard Klaassen, Mönchengladbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 254 days.

(21) Appl. No.: 10/740,727

(22) Filed: Dec. 19, 2003

(65) Prior Publication Data

US 2004/0149097 A1 Aug. 5, 2004

(30) Foreign Application Priority Data

Dec. 19, 2002 (DE) ..... 102 59 556

(51) Int. Cl.
*B31F 1/07* (2006.01)

(52) U.S. Cl. ..... 101/3.1; 101/4

(58) Field of Classification Search ..... 101/3.1, 101/4, 35, 18, 26; 270/57.31
See application file for complete search history.

(56) References Cited

U.S. PATENT DOCUMENTS 3,055,275 A * 9/1962 Schroter ..... 493/373
3,060,776 A * 10/1962 Bobst et al. ..... 83/103
3,728,921 A * 4/1973 Vogel ..... 83/151
3,975,057 A * 8/1976 Hurd ..... 406/84
4,015,495 A 4/1977 Yerly ..... 83/103
4,909,890 A * 3/1990 Bonnyman ..... 156/494
5,221,079 A 6/1993 Most et al. ..... 271/202
5,238,234 A * 8/1993 Kerber et al. ..... 271/1
5,348,285 A * 9/1994 Huser ..... 271/183
5,810,233 A 9/1998 Varidel ..... 225/97
6,315,287 B1 11/2001 Hirth et al. ..... 271/182
6,367,532 B1 * 4/2002 Miyake ..... 156/497
6,598,872 B1 * 7/2003 Gunschera et al. ..... 271/197
6,648,326 B2 * 11/2003 Hieb ..... 271/183
6,663,550 B2 * 12/2003 Frankenberger et al. .... 493/256

FOREIGN PATENT DOCUMENTS

DE 944 857 8/1955
DE 24 54 056 A1 9/1975
DE 41 19 511 A1 12/1992
DE 199 45 114 A1 3/2001
GB 2 032 322 A 5/1980

* cited by examiner

*Primary Examiner*—Anthony H. Nguyen
(74) *Attorney, Agent, or Firm*—Laurence A. Greenberg; Werner H. Stemer; Ralph E. Locher

(57) ABSTRACT

A sheet punching and embossing machine includes a device for stripping waste from a punched and embossed sheet at a stripping station, the device having a stripping plate for supporting the sheet. Also included are gripper carriages fixed to revolving chains, for gripping the sheet at a leading edge thereof and for then pulling the sheet intermittently through the stripping station and further stations in the machine. The stripping plate has, in an inlet region for the sheet and before stripping openings, at least one suction opening to which vacuum is applicable from below.

8 Claims, 3 Drawing Sheets

SHEET PUNCHING AND EMBOSSING MACHINE

BACKGROUND OF THE INVENTION

Field of the Invention

The invention relates to a sheet punching and embossing machine having a device for stripping waste from a punched and embossed sheet, the device having a stripping plate for supporting the sheets, and having gripper carriages fixed to revolving chains, for gripping the sheets at a leading edge thereof and then pulling the sheets intermittently through a stripping station and further stations in the machine.

The German Published Non-prosecuted Patent Application DE 41 19 511 A1, corresponding to U.S. Pat. No. 5,221,079, discloses a device for braking sheets, in particular, paper or board sheets, which are transportable on a conveyor belt in one plane and at a spaced distance from one another. Upstream from a pile-forming or stacking location, at the end of the machine, a braking device is provided wherein an overlapping or imbricated sheet stream is produced. The braking device is made up of a plurality of revolving belts and a guide table. The guide table is constructed as a suction table, and the belts are formed with suction holes spaced apart in the circumferential direction of the belts. In this manner, air between the belt and the sheet may be extracted or sucked away, so that the ends of the sheet from the inlet plane can be laid without any difficulty onto the belts, thereby affording fault-free overlapping of the sheets.

A device of the general type for stripping waste from sheets is described in the published German Non-prosecuted Patent Application (DE-OS) 24 54 056, corresponding to U.S. Pat. No. 4,015,495. The sheets are held on a gripper carriage and moved intermittently by a chain between stations. The stripping station, in this regard, has an upper part and a lower part, which perform upward and downward movements, and have stripping tools arranged thereon. The fixed intermediate center part is formed as a plate. In order to achieve the greatest possible utilization of the machine, the sheets are fed into the individual stations at high speed. The sheets coming from the punching station are sharply accelerated and braked and correctly positioned in the stripping station. The positioning of the gripper carriage is effected against a mechanical stop. Due to the great retardations and the movement against the mechanical stop, the sheet can be backed up or buckled behind the gripper carriage, and inadequate positioning of the sheet in the stripping station can occur.

SUMMARY OF THE INVENTION

It is accordingly an object of the invention to provide an improved stripping station of a sheet punching and embossing machine for holding the sheet as it is fed into the stripping station, so as to avoid backing up or buckling of the sheet behind the gripper carriage.

With the foregoing and other objects in view, there is provided, in accordance with the invention, a sheet punching and embossing machine. The machine contains a stripping station for stripping waste from a punched and embossed sheet. The stripping station has a stripping plate for supporting the sheet. The stripping plate has stripping openings and an inlet region for receiving the sheet. The inlet region has at least one suction opening disposed upstream of the stripping openings, and the suction opening is provided for receiving a vacuum applied from below. Further processing stations are disposed in the machine. Revolving chains are provided and gripper carriages are fixed to the revolving chains for gripping the sheet at a leading edge thereof and for then pulling the sheet intermittently through the stripping station and the further stations.

In accordance with an added feature of the invention, the suction opening is one of a plurality of suction openings disposed in the stripping plate in at least one row extending transversely with respect to a sheet running direction. Alternatively, the suction opening is one of a plurality of suction openings disposed in the stripping plate in two successive rows extending transversely with respect to a sheet running direction. The rows are disposed one after another in the sheet running direction.

In accordance with an additional feature of the invention, the stripping station has a pressure line and a suction bar with a plurality of suction openings. The suction bar is disposed in the stripping plate and extends transversely to a sheet running direction. The suction bar is connected to the pressure line. Alternatively, the stripping station has four suction bars each with a plurality of suction openings. The suction bars are disposed in the stripping plate and extend transversely to a sheet running direction. The suction bars are each connected to the pressure line. Preferably, at least two rows of the suction bars are disposed in the stripping plate in the sheet running direction.

In accordance with a further feature of the invention, the stripping station contains a controllable unit for producing vacuum, respectively, for depressurizing and for providing positive pressure. The controllable unit for producing vacuum is fixed to an underside of the stripping plate, in vicinity of each of the suction openings, respectively, and is connected through the pressure line to each of the suction openings.

In accordance with a concomitant feature of the invention, a controllable unit for producing vacuum is provided for depressurizing and for providing positive pressure. The controllable unit for producing vacuum is fixed to an underside of the stripping plate, in vicinity of the suction bar, and connected through the pressure line to the suction bar.

Thus, the object of the invention is achieved by providing the stripping plate, in the inlet region of the sheets and before the stripping openings, with at least one suction opening to which vacuum can be applied from below. As a result of the arrangement of a suction opening in the inlet region of the sheets, the sheet can be drawn or sucked directly to the stripping station during feeding. The vacuum at the suction opening draws the sheet onto the stripping plate and thus prevents the sheet from backing up or buckling during the retardation of the gripper carriage and upon striking the mechanical stop.

Other features which are considered as characteristic for the invention are set forth in the appended claims.

Although the invention is illustrated and described herein as embodied in a sheet punching and embossing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
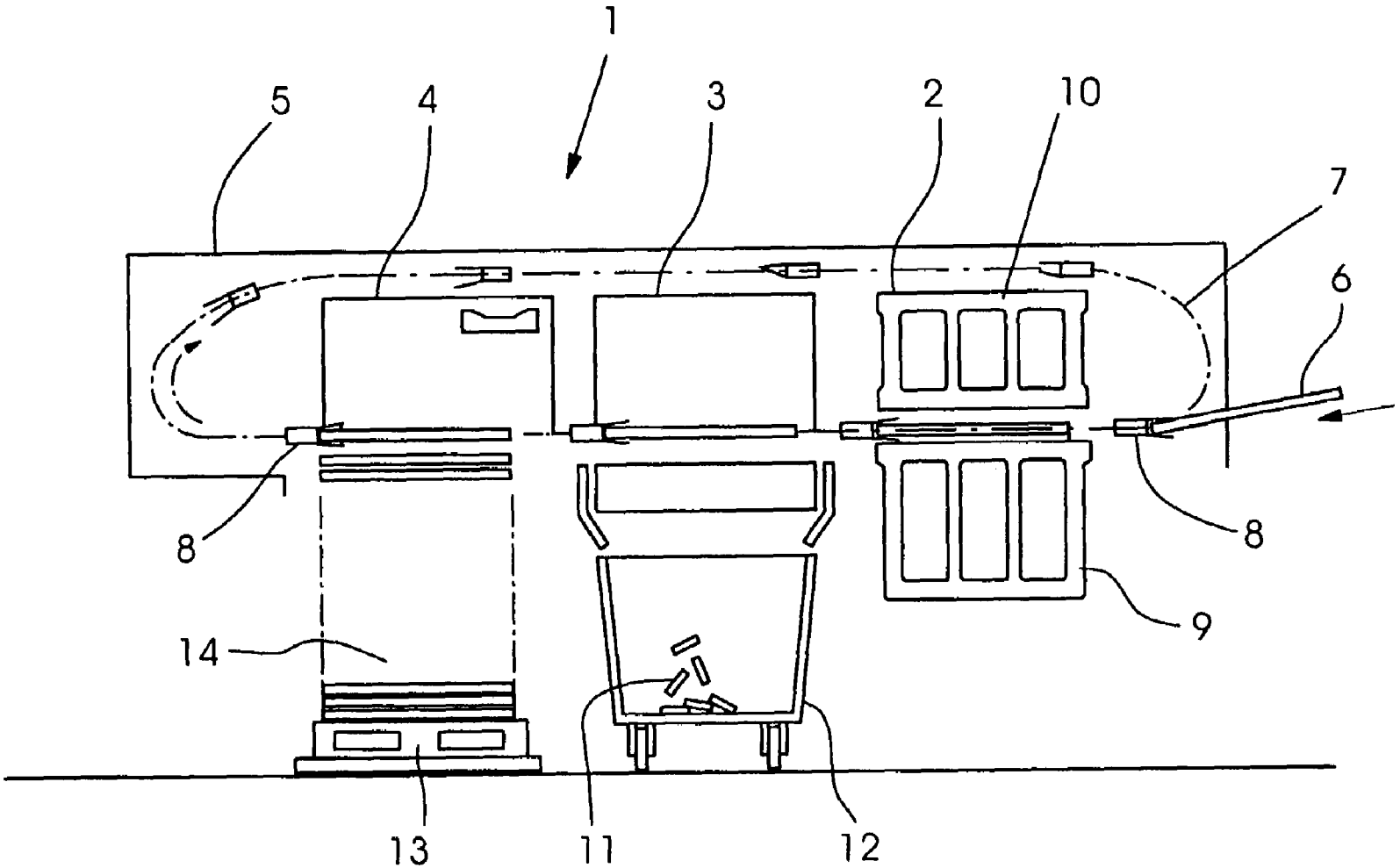
FIG. 1 is a schematic and diagrammatic side elevational view of the main structure of a sheet punching and embossing machine.

Referring now to the drawings and, first, particularly to FIG. 1 thereof, there is shown therein a basic structure of a sheet punching and embossing machine 1 for punching, stripping and depositing sheets 6 of paper, paperboard and the like. The punching and embossing machine 1 includes a punching device 2, a stripping device 3 and a depositing device 4, which are carried and enclosed by a common machine housing 5.

The sheets 6 are gripped at respective leading edges thereof by gripper bars 8 fixed to revolving chains 7, and are intermittently pulled through the various stations 2, 3 and 4 of the punching and embossing machine 1.

The punching station 2 has a lower table 9 and an upper table 10. The lower table 9 is fixedly mounted in a frame of the machine 1 and is provided with a plate opposing a punching knife provided in the upper table 10 which is mounted so as to be reciprocatingly movable vertically.

The gripper bar 8 transports the sheet from the punching and embossing machine 2 into a next following stripping station 3, which is equipped with stripping tools. In the stripping station 3, with the aid of these stripping tools, the nonrequired pieces of waste are expelled downwardly away from the sheet 6, as a result of which the pieces of waste 11 fall into a container-like cart 12 that has been pushed in under the station 3.

From the stripping station 3, the sheet passes into a depositing station 4, wherein the sheet is either only simply deposited or, however, simultaneous separation of the individual blanks is performed. The depositing station 4 can also contain a pallet 13, whereon the individual sheets are stacked up in the form of a stack or pile 14, so that after a specific stack or pile height has been attained, the pallets 13 with the sheets 14 piled or stacked up thereon can be moved away out of the region of the punching and embossing machine 1.

As is believed to be apparent, the chains 7 carry a plurality of gripper bars 8, for example, eight gripper bars shown here, so that a plurality of sheets 6 can be processed simultaneously in the various stations 2, 3 and 4.

Figure 2:
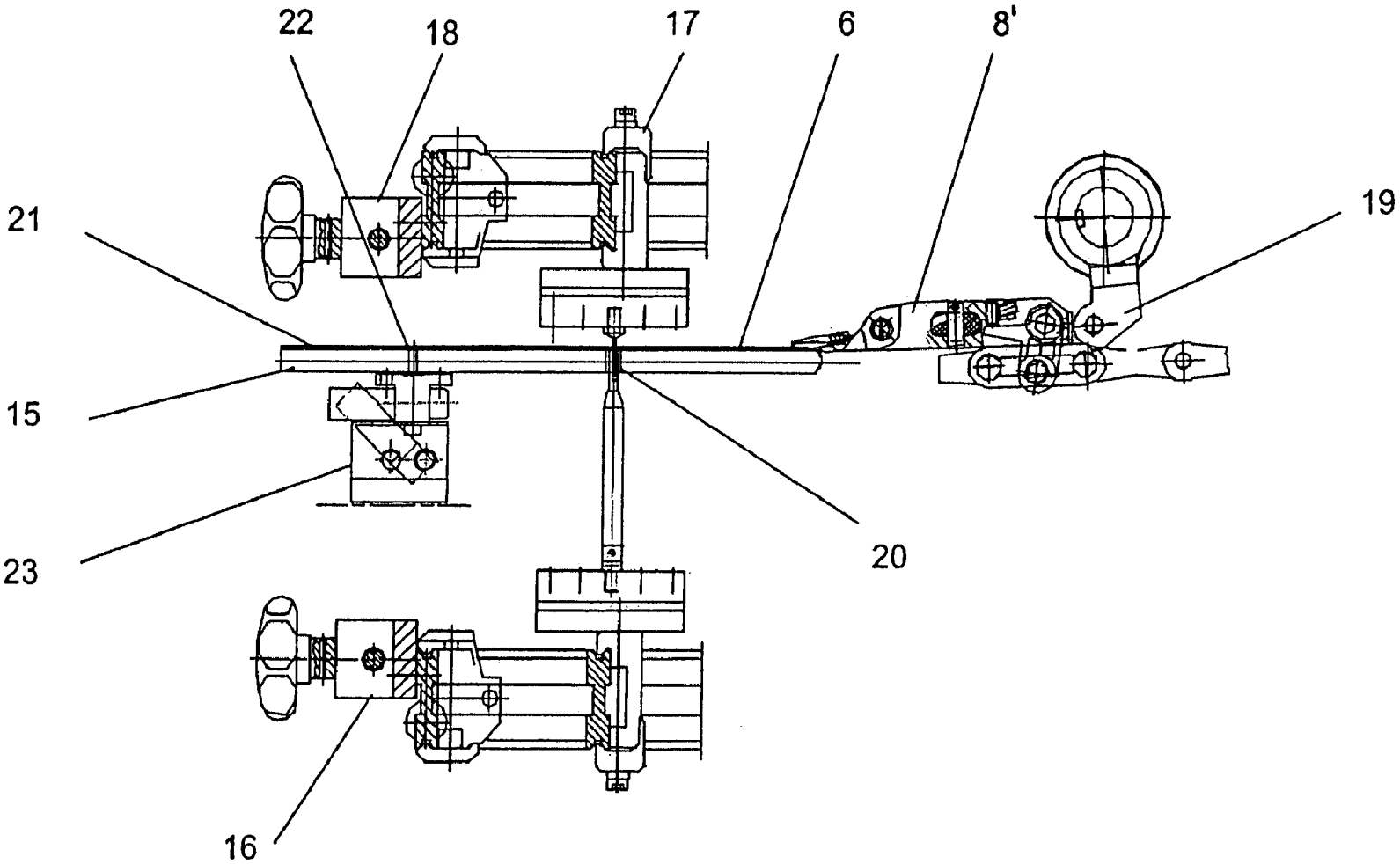
FIG. 2 is an enlarged fragmentary side elevational view of FIG. 1, showing a stripping station of the sheet punching and embossing machine.

In FIG. 2, a preferred embodiment of the stripping device 3 of the punching and embossing machine 1, which is constructed in accordance with the invention, is illustrated in greater detail. The stripping device 3 includes a stripping plate 15 and two holding frames 18 and 16 which are provided with stripping tools 17 and can be moved vertically reciprocatingly. The sheet 6 is held in the stripping station 3 by a gripper carriage 8' and the latter is, in turn, held by a register stop 19. In order to strip the waste, stripping openings 20 are machined into the stripping plate 15.

The sheet 6 oncoming from the punching station 2 is fed to the stripping station 3. Suction openings 22 are provided in the stripping plate 15 in an inlet region 21 thereof. Controllable pneumatic units 23 are fixed to the underside of the stripping plate 15.

The sheets 6 are fed to the stripping station 3 at high cycle frequencies and, accordingly, high speeds. Braking the gripper carriage 8' is likewise performed with high retardation, so that the sheet 6 backs up behind the gripper carriage 8' and comes to lie buckled or warped under the stripping tool 17 if no suitable countermeasures are taken. By introducing the suction openings 22 in accordance with the invention, the sheet 6 is then drawn or sucked against the stripping plate 15 as the sheet 6 is fed into the stripping station 3, and is braked at the trailing side or edge thereof. The sheet 6 is thus under continuous tension as it is fed in, and cannot back up or buckle. In order to avoid holding the sheets 6 unnecessarily firmly as they move out of the stripping station 3, controllable pneumatic units 23 are arranged underneath the suction openings 22. The controllable pneumatic units 23 are capable of producing a vacuum, depressurizing the suction openings 22 and leading a positive pressure to the suction openings 22.

In order to move the sheets 6 out, the vacuum can then be switched off and the suction openings 22 can be provided with a positive pressure. The positive pressure causes the sheets 6 to be loosened or separated from the stripping plate 15. In particular, the use of antistatic compressed air has proven to be advantageous.

The suction openings 22 are preferably arranged in the inlet region 21 of the stripping station. This offers the advantage that the sheets 6 can be gripped by the vacuum of the suction openings 22 immediately at the start of the insertion thereof into the stripping station 3, so that the sheets 6 are held under tension during the entire feeding time. In a preferred embodiment of the invention, two rows of suction openings 22 are arranged after one another in the stripping plate 15 in the sheet running or travel direction, as represented by the accompanying directional arrow in FIG. 1.

Figure 3:
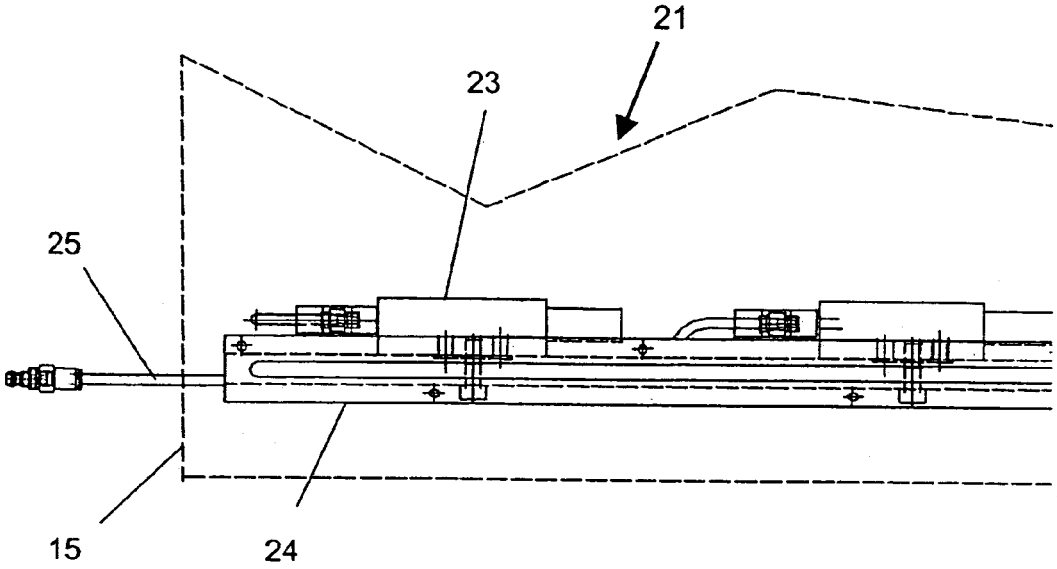
FIG. 3 is a plan view of an inlet region of a stripping plate formed with stripping openings.

FIG. 3 is a plan view of the inlet region 21 of a stripping plate 15. The stripping plate 15 is provided with suction bars 24 having a plurality of suction openings 22, in this case, three suction openings 22, however, two or more than three suction openings 22 can also be provided in the suction bars 24. In order to produce greater retention and greater tension on the sheets 6, in this preferred exemplary embodiment, two rows of suction bars 24 are arranged after one another in the sheet running direction. The suction bars 24 are connected to the pneumatic units 23 via pressure lines 25, as illustrated in FIG. 4.

Figure 4:
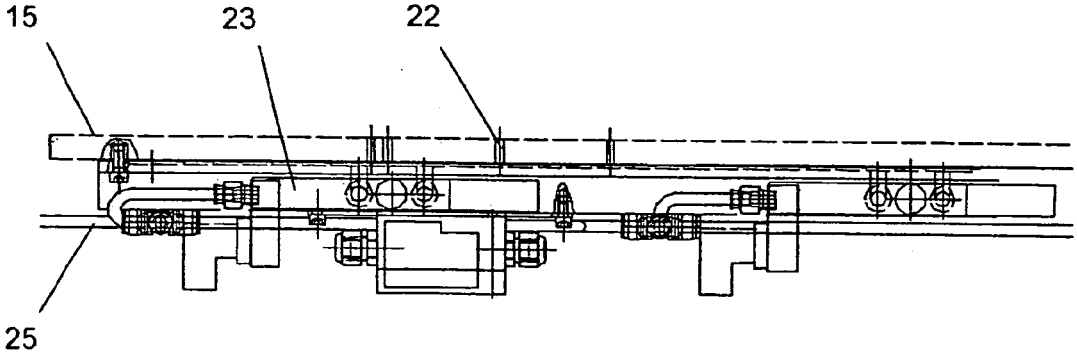
FIG. 4 is a sectional view of FIG. 3 taken along the line IV—IV in the direction of the arrows, showing the stripping plate in the vicinity of a suction bar.

FIG. 4 is a sectional view of FIG. 3 taken along the line IV—IV. A section through the stripping plate 15 in the inlet region 21 is shown therein. The suction bars 24 are introduced into the stripping plate 15 as inserted parts. On the underside of the stripping plate 15, the suction openings 22 of the suction bars 24 are connected to the controllable pneumatic units 23 via a pressure line 25. The pneumatic unit 23, in turn, has a positive pressure applied thereto via a pressure line 25. Through the intermediary of the pneumatic unit 23, the suction opening 22 can be provided with a vacuum or a positive pressure. It is likewise possible to depressurize the pressure line 25 but, should the stripping unit not be used, the suction openings 22 can be depressurized.

We claim:

1. A sheet punching and embossing machine, comprising:

a stripping station for stripping waste from a punched and embossed sheet, said stripping station having a stripping plate for supporting the sheet, said stripping plate having stripping openings formed therein and an inlet region for receiving the sheet, said inlet region having at least one suction opening formed therein disposed upstream off said stripping openings, said suction opening provided for receiving a vacuum applied from below;

further stations;

revolving chains; and gripper carriages fixed to said revolving chains and gripping the sheet at a leading edge thereof and for then pulling the sheet intermittently through said stripping station and said further stations.

2. The sheet punching and embossing machine according to claim 1, wherein said suction opening is one of a plurality of suction openings disposed in said stripping plate in at least one row extending transversely with respect to a sheet running direction.

3. The sheet punching and embossing machine according to claim 1, wherein said suction opening is one of a plurality of suction openings disposed in said stripping plate in two successive rows extending transversely with respect to a sheet running direction, said rows disposed one after another in the sheet running direction.

4. The sheet punching and embossing machine according to claim 1, wherein:

said stripping station has a pressure line; and said stripping station has a suction bar with a plurality of suction openings formed therein, said suction bar disposed in said stripping plate and extending transversely to a sheet running direction, said suction bar connected to said pressure line.

5. The sheet punching and embossing machine according to claim 1, wherein:

said stripping station has a pressure line; and said stripping station has four suction bars each with a plurality of suction openings formed therein, said suction bars disposed in said stripping plate and extending transversely to a sheet running direction, said Suction bars connected to said pressure line.

6. The sheet punching and embossing machine according to claim 5, wherein at least two rows of said suction bars are disposed in said stripping plate in the sheet running direction.

7. The sheet punching and embossing machine according to claim 4, wherein said stripping station contains a controllable unit for producing vacuum, for depressurizing and for providing positive pressure, said controllable unit being fixed to an underside of said stripping plate, and being connected through said pressure line to each of said suction openings.

8. The sheet punching and embossing machine according to claim 4, further comprising a controllable unit for producing vacuum, for depressurizing, and for providing positive pressure, said controllable unit being fixed to an underside of said stripping plate, and connected through said pressure line to said suction bar.

* * * * *